US009540152B2

(12) United States Patent
Roesler

(10) Patent No.: US 9,540,152 B2
(45) Date of Patent: Jan. 10, 2017

(54) PACKAGING CONTAINER WITH A BAYONET TWIST CLOSURE AND FREE RUNNING

(71) Applicant: Peter Roesler, Wangen (DE)

(72) Inventor: Peter Roesler, Wangen (DE)

(73) Assignee: Rose Plastic AG (DE)

( * ) Notice: Subject to any disclaimer, the term of this patent is extended or adjusted under 35 U.S.C. 154(b) by 0 days.

(21) Appl. No.: 14/487,353

(22) Filed: Sep. 16, 2014

(65) Prior Publication Data

US 2015/0076140 A1 Mar. 19, 2015

(30) Foreign Application Priority Data

Sep. 16, 2013 (DE) ..... 10 2013 015 270

(51) Int. Cl.

| | |
|---|---|
| ***B65D 41/04*** | (2006.01) |
| ***B65D 6/00*** | (2006.01) |
| ***B65D 25/14*** | (2006.01) |
| ***B65D 21/08*** | (2006.01) |

(52) U.S. Cl.

CPC ..... *B65D 41/0492* (2013.01); *B65D 11/00* (2013.01); *B65D 21/086* (2013.01); *B65D 25/14* (2013.01)

(58) Field of Classification Search

CPC ..... B65D 85/00; B65D 21/08; B65D 11/02; B65D 41/04

USPC ..... 220/4.01, 4.03, 8

See application file for complete search history.

(56) References Cited

U.S. PATENT DOCUMENTS

| | | | | |
|---|---|---|---|---|
| 4,210,253 | A * | 7/1980 | Rosler | B65D 85/20 220/8 |
| 4,596,340 | A * | 6/1986 | Luther | B65D 21/086 220/8 |
| 5,605,242 | A * | 2/1997 | Hwang | 220/8 |
| 5,680,949 | A * | 10/1997 | Roesler | 220/8 |

* cited by examiner

*Primary Examiner* — Anthony Stashick
*Assistant Examiner* — Raven Collins
(74) *Attorney, Agent, or Firm* — Cohena Grigsby, PC

(57) ABSTRACT

A packaging container for elongated objects that includes an outer sleeve (1) with at least one threaded section (4) and an inner sleeve (2) with at least one toothed or threaded strip (3) that can be brought into threaded engagement with the threaded section (4) such that the inner sleeve can be screwed into the interior of the outer sleeve (1). The at least one threaded section (4) is interrupted by at least one sliding strip (5) that is aligned in the longitudinal direction of said packaging container and that interrupts the threaded section (4), the width of the sliding strip (5) being greater than the width of the toothed or threaded strip (3).

8 Claims, 1 Drawing Sheet

PACKAGING CONTAINER WITH A BAYONET TWIST CLOSURE AND FREE RUNNING

BACKGROUND OF THE INVENTION

Field of the Invention

The presently disclosed invention relates to packaging containers for elongated objects. In an embodiment, the packaging container includes an outer sleeve that has at least one threaded section on the outer circumference and an inner sleeve that fits inside the outer sleeve. The packaging container has a bayonet twist closure wherein the treaded section of the outer sleeve may be threadingly engageable with at least one toothed or threaded strip that is located on the outside circumference of the inner sleeve such that the inner sleeve can be screwed into the interior of the outer sleeve.

Discussion of the Prior Art

Packaging containers such as disclosed in DE 28 51 096 C2 are known. In such packaging containers, the bayonet twist closure includes an elongated toothed or threaded strip that extends along the wall in the longitudinal direction and that is disposed on the outside circumference of the inner sleeve. A threaded section is disposed on the opposite or facing side of the outer sleeve in the mouth area of the outer sleeve. The threaded section corresponds to the toothed or threaded strip and can be engaged with the toothed or threaded strip.

The advantage of such a packaging container is that the total length of the packaging container can be adapted to the object disposed in the interior. Depending on the extent to which the inner sleeve is inserted into the outer sleeve and is locked in place in the outer sleeve, the object may be in contact with the bottom surface of the inner sleeve and the bottom surface of the outer sleeve at both ends and may thus be held therein without any play.

However, the packaging container according to DE 28 51 096 C2 has the disadvantage that a continuous thread is provided. The disadvantage is that the inner sleeve must be turned through multiple turns of the inner sleeve relative to the stationary outer sleeve (or vice versa) until achieving the desired package length.

With this type of packaging, it is known that the inner sleeve can be inserted into the outer sleeve—as seen in the longitudinal direction—so that the toothed or threaded strip disposed on the outside circumference of the inner sleeve is shifted on the circumference of the outer sleeve while overcoming elastically the threaded section. However, the disadvantage of this insertion movement is that the intermeshing parts of the toothed and threaded strip quickly form a seal with the threaded section and then lose their holding force with continued use over time.

Another disadvantage is that with relatively heavy packaging contents (a drill bit, for example), there is a risk that the two sleeve parts may unintentionally twist relative to one another because of the thread pitch of the toothed or threaded strip on the outside circumference of the inner sleeve in comparison with the threaded section on the inside circumference of the outer sleeve, thus unintentionally opening the package.

SUMMARY OF THE INVENTION

The object of the invention is therefore to improve a packaging container having a bayonet twist closure according to the subject matter of DE 28 51 096 C2, so as to provide a rapid adjustment of the package length between the inner sleeve and the outer sleeve without undue wear.

According to another object, unintentional separation of the intermeshing threaded sections of the sleeve parts can be avoided in any case, even with heavy objects.

To achieve these and other objects, the packaging container for elongated objects includes an outer sleeve that has an outside circumference that defines an inner surface having at least one threaded section. The at least one threaded section can be threadingly engaged with at least one toothed or threaded strip that is located on an outside surface that is defined by the circumference of an inner sleeve. The toothed or threaded strip can be screwed into the interior of the outer sleeve. The at least one threaded section that is located on the inner surface of the outside circumference of the outer sleeve is interrupted by at least one sliding strip that breaks through the threaded section in the longitudinal direction. The width of the sliding strip is greater than the width of the toothed or threaded strip on the inner sleeve.

In an embodiment of the disclosed invention, in the region of the threaded section disposed peripherally, sliding strips break through the threaded section in the longitudinal direction. The width of the sliding strip is at least greater than the width of the toothed or threaded strip.

At times when the toothed or threaded strip on the outside circumference of the inner sleeve is flush, or angularly aligned, with the sliding strip that breaks the threaded section of the outer sleeve, the two parts (inner sleeve and outer sleeve) are freely displaceable in the longitudinal direction relative to one another.

The disclosed invention affords an advantage that a continuous threaded connection between the two parts (outer sleeve and inner sleeve) is avoided, as proposed in DE 28 51 096 C2.

Instead, the threaded section disposed on the inside surface of the outer sleeve is present only in segments and does not run peripherally, or angularly, 360° around the inside surface of the outer sleeve. Instead, the outer sleeve includes a plurality of sliding strips on the inside surface, each sliding strip being oriented in the longitudinal direction of said packaging container and angularly located oppositely from one another in the range of approximately 180°. The sliding strips interrupt the threaded section and the width of the sliding strips is at least somewhat greater than the width of the toothed or threaded strips of the inner sleeve so that the toothed or threaded strips are freely displaceable longitudinally along the sliding strip.

When it is stated in the following description that the threaded section is disposed on the inside surface of the outer sleeve and is interrupted or broken by at least two sliding strips and that, furthermore, at least two toothed or threaded strips are disposed on the outside surface of the inner sleeve so they are angularly offset by 180° from one another, this is not to be understood to be restrictive for the present invention. The outer and inner sleeves may be interchangeable. Accordingly, the threaded section may be disposed on the outside surface of the inner sleeve and then the opposing sliding strips may be provided in this location, and furthermore, the toothed or threaded strip may be disposed on the inner surface of the outer sleeve.

The terms outer sleeve and inner sleeve are thus mutually interchangeable together with all the function parts that are assigned below to the outer sleeve or inner sleeve respectively.

In a preferred embodiment, it is additionally provided that a turn brake is disposed on the thread inlet and on the thread outlet of the threaded section.

Such a turn brake consists of a peripheral ridge or groove running in the circumferential direction, interrupted only in the region of the respective sliding strip.

The peripheral ridge or groove does not have a thread pitch. Instead, it is directed horizontally in comparison with the thread pitch of the threaded section in which the threads are oriented obliquely.

This configuration of such a turn brake ensures that in the locked state of the two sleeve parts, at least one tooth of the toothed or threaded strip engages in the region of the annular thread-type or groove-type turn brake that runs horizontally on the outside surface of the inner sleeve and is secured there.

This tooth is thus locked by the thread-type or groove-typed turn brake running horizontally and the two parts cannot unintentionally twist apart from one another.

The inventive subject matter of the present invention is thus derived not only from the subject matter of the individual patent claims but also from the combination of the individual patent claims with one another.

All information and features disclosed in the documents, including the abstract, in particular the three-dimensional design depicted in the drawings, are claimed as essential to the invention inasmuch as they are novel individually or in combination in comparison with the prior art.

BRIEF DESCRIPTION OF THE DRAWINGS

The invention is explained in greater detail below on the basis of drawings illustrating only one presently preferred embodiment. Additional features of the invention and advantages of the invention are derived from the drawings and the description thereof.

They show.

DESCRIPTION OF A PRESENTLY PREFERRED EMBODIMENT

According to FIGS. 1 through 4, an outer sleeve 1, which is designed as a cylindrical hollow body, preferably made of a plastic material, can be locked to an inner sleeve 2.

Figure 1:
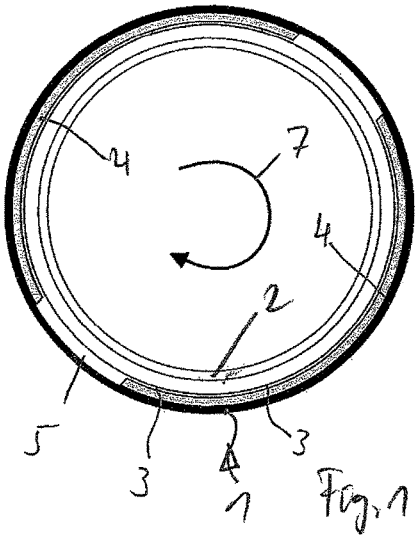
FIG. 1: a horizontal section through the thread connecting part between the inner sleeve and the outer sleeve in the locked state according to FIG. 3.
Figure 3:
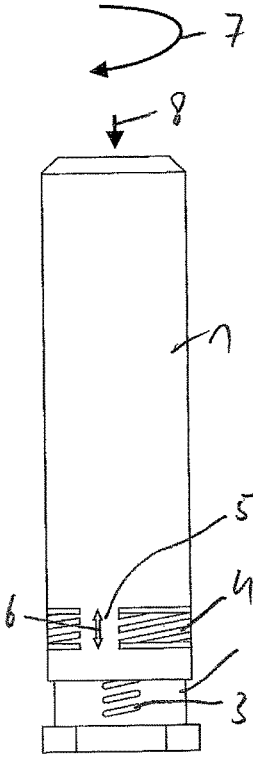
FIG. 3: a side view of the configuration according to FIG. 1.

The engaged position is illustrated in FIGS. 1 and 3. It can be seen here that a threaded section 4 is present on the inside surface of the outer sleeve 1, consisting of groove-type threads running obliquely with respect to the longitudinal direction of the packaging container, such that an annular groove-type threads running horizontally is provided at the inlet and the outlet of the threaded section, referred to below as turn brakes 9 and 10.

It is fundamentally sufficient for the design of the turn brake if an annular groove in the form of the turn brake 9, 10 is disposed either only at the inlet or only at the outlet of the threaded section 4.

In a preferred embodiment, however, the turn brake 9, 10 is disposed both at the inlet and at the outlet of the threaded section 4. This creates a particularly load-bearing turn brake.

The inner sleeve 2 has toothed or threaded strips 3, which are preferably angularly offset by 180° from one another around the circumference of the inner sleeve. Each of the toothed or threaded strips is designed with teeth or threaded sections running obliquely, such that their pitch corresponds approximately to the pitch of the threads in threaded section 4 on the surface of the outer sleeve 1.

In the locked state according to FIGS. 1 and 3, the toothed or threaded strips 3 of the inner sleeve 2 engage in the respective threaded section 4 on the outer sleeve 1 in the manner of a thread engagement, and the two parts are thereby secured with respect to one another.

To adjust the effective length of the packaging formed from the outer sleeve 1 and the inner sleeve 2, for example, the outer sleeve 1 is twisted in the direction of the arrow 7 with respect to the stationary inner sleeve 2, so that the threaded sections 3, 4 remain engaged with one another and the two packaging parts can be adjusted continuously in their length.

Figure 2:
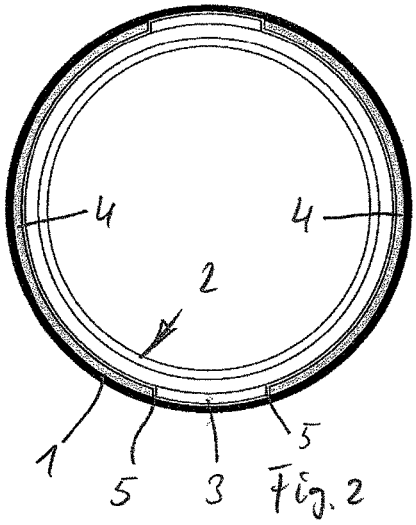
FIG. 2: the same section as that according to FIG. 1, but in the unlocked state in the function of the sliding strip according to FIG. 4.
Figure 4:
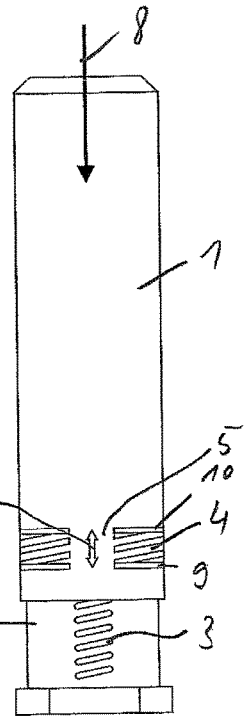
FIG. 4: a side view of the configuration according to FIG. 2.

To achieve a faster adjustment of the packaging length according to the invention or to achieve a faster opening of the entire package without having to apply force, the invention now provides according to FIGS. 2 and 4 that the threaded section 4 is interrupted on the surface of the outer sleeve 1, namely through sliding strips 5 running in the longitudinal direction.

The width of the sliding strip 5 is at least as great as the width of the toothed or threaded strip 3 on the outside surface of the inner sleeve 2. It is therefore possible now for the first time for the two parts 1, 2 to be rotated by mutual turning, so that the sliding strip 5 is brought into angular alignment with the toothed or threaded strip 3 on the outside surface of the inner sleeve 2. When this is the case, the two parts 1, 2 can be displaced easily relative to one another in the direction of the arrow 8 and in the opposite direction without any great shifting resistance, which was not previously known in the prior art.

To restore a certain engaged position, after free displacement of the inner sleeve with respect to the outer sleeve according to FIG. 4, one of the inner sleeve or outer sleeve is rotated with respect to the other in the direction of the arrow 7, so that now the toothed or threaded strip 3 on the inner sleeve again comes into threaded engagement with the threaded section 4 on the outer sleeve. This is illustrated in FIG. 1.

It is thus possible for the first time now to induce a longitudinally axial displacement movement in the direction of the arrow 8 and in the opposite direction to that, instead of a rotational movement in the direction of the arrow 7, to adjust the effective packaging length between the two parts 1, 2.

Figure 5:
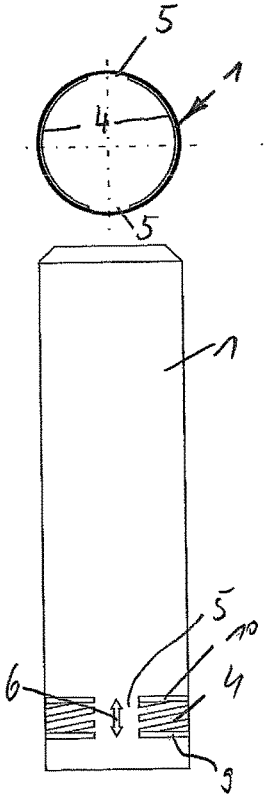
FIG. 5: a side view and the front view of the outer sleeve.

FIG. 5 shows that it is preferable if the threaded section 4 is interrupted by opposing sliding strips 5.

The invention is not limited to the configuration of two opposing sliding strips 5. It is also possible for just one sliding strip to be present, which corresponds to a respective single toothed or threaded strip 3.

Likewise, however, more than two sliding strips (for example, three or four) may also be present, and this number of sliding strips 5 is then opposed by an equal number of toothed or threaded strips 3 on the opposite part.

Figure 6:
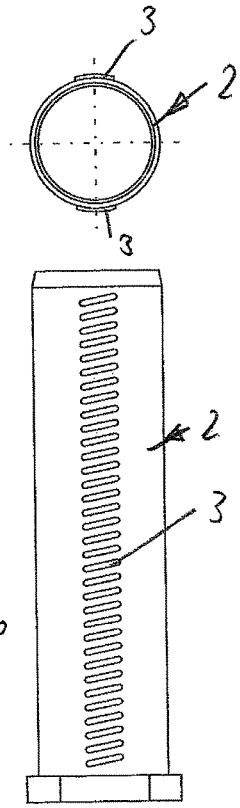
FIG. 6: a side view and the front view of the inner sleeve.

FIG. 6 shows here that, as in the embodiment according to FIG. 5, it is preferable if the toothed or threaded strip 3 is disposed with a 180° offset on the circumference.

Furthermore, it is preferable if a so-called function indicator 6 consisting of a double arrow is disposed in the region of the sliding strip 5 to also indicate visually that, when the toothed or threaded strip 3 on the outside surface of the inner sleeve 2 is aligned with the sliding strip 5, the two parts are freely displaceable relative to one another in the direction of the arrow 8 according to FIG. 4.

LEGEND TO DRAWINGS

1 Outer sleeve
2 Inner sleeve
3 Toothed or threaded strip (of 2)
4 Threaded section (of 1)
5 Sliding strip
6 Function indicator
7 Direction of arrow and/or direction of rotation
8 Direction of arrow and/or direction of rotation
9 Turn brake
10 Turn brake

What is claimed is:

1. A packaging container for elongated objects, said packaging container comprising:

an outer sleeve that defines an inner surface, said outer sleeve including at least one threaded section on the inner surface, said threaded section having an inlet end and an outlet end, said threaded section having at least one thread having a pitch such that said thread is oriented obliquely to the longitudinal axis of said outer sleeve, said threaded section further including at least one horizontal annular groove on the inner surface of said outer sleeve and that is oriented in the circumferential direction, said horizontal annular groove being disposed at least one of said inlet end and said outlet end of the threaded section;

an inner sleeve that defines an outer surface, said inner sleeve being positioned inside said outer sleeve such that at least a portion of the outer surface of said inner sleeve opposes at least a portion of the inner surface of said outer sleeve, the outer surface of said inner sleeve having at least one threaded strip that includes teeth having a pitch such that said teeth are oriented obliquely to the longitudinal axis of said inner sleeve, the pitch of the teeth of said inner sleeve corresponding to the pitch of the threads of said threaded section, such that when said threaded strip is brought into threaded engagement with said at least one threaded section, said inner sleeve is continuously displaceable along the longitudinal axis of said packaging container with respect to said outer sleeve by rotation of said outer sleeve with respect to said inner sleeve; and at least one sliding strip that interrupts at least one threaded section on the inside surface of the outer sleeve to define a breach in the threaded section, said sliding strip being longitudinally oriented in the longitudinal dimension of said packaging container, said sliding strip having a width that is greater than the width of the threaded strip on the inner sleeve, each of said horizontal annular grooves being interrupted in the region of the sliding strip and cooperating with a thread of said threaded section to define a turn brake that locks movement of said outer sleeve with respect to said inner sleeve.

2. The packaging container according to claim 1 wherein said threaded section that is disposed on the inside surface of said outer sleeve is segmented or interrupted by said sliding strips and wherein at least two of said sliding strips that segment or interrupt the threaded section are angularly located on said inner sleeve approximately 180° apart and opposite one another.

3. A packaging container for elongated objects, said packaging container comprising:

an inner sleeve that defines an outer surface, said inner sleeve including at least one threaded section on said outer surface, said threaded section having an inlet end and an outlet end, said threaded section having at least one thread with a pitch such that said thread is oriented obliquely to the longitudinal axis of said inner sleeve, said threaded section further including at least one horizontal annular groove on the outer surface of said inner sleeve and that is oriented in the circumferential direction, said horizontal annular groove being disposed at at least one of said inlet end and said outlet end of the threaded section;

an outer sleeve that defines an inner surface, said outer sleeve being positioned outside of said inner sleeve such that at least a portion of the inner surface of said outer sleeve opposes at least a portion of the outer surface of said inner sleeve, said outer sleeve having at least one threaded strip on the inner surface, said threaded strip having teeth with a pitch such that said teeth are oriented obliquely to the longitudinal axis of said outer sleeve, the pitch of the teeth of said outer sleeve corresponding to the pitch of the threads of said threaded section such that said threaded strip is threadingly engageable with said at least one threaded section, such that said inner sleeve is continuously displaceable along the longitudinal axis of said packaging container with respect to said outer sleeve by rotation of said outer sleeve with respect to said inner sleeve; and at least one sliding strip that interrupts said at least one threaded section on the outer surface of the inner sleeve to define a breach in said threaded section, said sliding strip being longitudinally oriented in the longitudinal dimension of the packaging container, the width of said sliding strip being greater than the width of the threaded strip of said outer sleeve, each of said horizontal annular grooves being interrupted in the region of the sliding strip and cooperating with a thread of said threaded section to define a turn brake that locks movement of said outer sleeve with respect to said inner sleeve.

4. The packaging container according to claim 3 wherein said threaded section that is disposed on the outside surface of said inner sleeve is segmented or interrupted by said sliding strips and wherein at least two of said sliding strips that segment or interrupt the threaded section are angularly located on said outer sleeve approximately 180° apart and opposite one another.

5. The packaging container according to claim 1, said packaging container having a locked state wherein at least one tooth of the threaded strip of the inner sleeve engages the horizontally peripheral annular groove of the outer sleeve to secure the outer sleeve with respect to said inner sleeve.

6. The packaging container according to claim 3, said packaging container having a locked state wherein at least one tooth of the threaded strip of the outer sleeve engages the horizontally peripheral annular groove of the inner sleeve to secure the inner sleeve with respect to said outer sleeve.

7. The packaging container according to claim 1 wherein at least one of said annular grooves that is disposed at at least one of the inlet and the outlet of the threaded section on the outer sleeve engages at least one thread of the threaded strip on the inner sleeve.

8. The packaging container of claim 3 wherein at least one of said annular grooves that is disposed at at least one of the inlet and the outlet of the threaded section on the inner sleeve engages at least one thread of the threaded strip on the outer sleeve.

* * * * *